US010260690B2

(12) United States Patent
Miyahara

(10) Patent No.: US 10,260,690 B2
(45) Date of Patent: Apr. 16, 2019

(54) LIGHTING APPARATUS

(71) Applicant: PANASONIC INTELLECTUAL PROPERTY MANAGEMENT CO., LTD., Osaka (JP)

(72) Inventor: Yuta Miyahara, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 21 days.

(21) Appl. No.: 15/713,885

(22) Filed: Sep. 25, 2017

(65) Prior Publication Data

US 2018/0087727 A1 Mar. 29, 2018

(30) Foreign Application Priority Data

Sep. 29, 2016 (JP) ..... 2016-192304

(51) Int. Cl.

| | |
|---|---|
| ***F21V 21/005*** | (2006.01) |
| ***F21S 2/00*** | (2016.01) |
| ***F21K 9/20*** | (2016.01) |
| ***F21V 15/01*** | (2006.01) |
| ***F21V 23/02*** | (2006.01) |
| ***F21V 23/04*** | (2006.01) |
| ***F21S 4/28*** | (2016.01) |
| *F21Y 103/10* | (2016.01) |
| *F21V 3/02* | (2006.01) |

(Continued)

(52) U.S. Cl.

CPC ..... *F21S 2/005* (2013.01); *F21K 9/20* (2016.08); *F21S 4/28* (2016.01); *F21V 15/01* (2013.01); *F21V 23/023* (2013.01); *F21V 23/045* (2013.01); *F21V 3/02* (2013.01); *F21V 3/061* (2018.02); *F21V 3/062* (2018.02); *F21V 15/015* (2013.01); *F21Y 2103/10* (2016.08); *F21Y 2113/00* (2013.01); *F21Y 2115/10* (2016.08)

(58) Field of Classification Search

CPC ..... F21Y 2105/10; F21Y 2103/10; F21Y 2113/00; F21S 2/005; F21S 4/28; F21S 4/20; F21K 9/20; F21V 15/01; F21V 15/015; F21V 23/023; F21V 23/045

See application file for complete search history.

(56) References Cited

U.S. PATENT DOCUMENTS

2008/0037239 A1* 2/2008 Thomas ..... F21V 15/013 362/92
2010/0171404 A1* 7/2010 Liu ..... F21V 29/507 313/46

(Continued)

FOREIGN PATENT DOCUMENTS

JP 2010-050015 3/2010

*Primary Examiner* — Y M. Lee
(74) *Attorney, Agent, or Firm* — Greenblum & Bernstein, P.L.C.

(57) ABSTRACT

A lighting apparatus includes a main body that is elongated; a light emitter disposed on a top surface of the main body; and a light-transmissive cover that is elongated along a lengthwise direction of the main body and covers the light emitter from above. The lighting apparatus includes a substrate having a major surface; and a receiver that is disposed on the major surface and receives the radio waves. The substrate is disposed on a side of the main body in the lengthwise direction, in such an orientation that the major surface intersects the lengthwise direction.

8 Claims, 6 Drawing Sheets

(51) Int. Cl.

| | |
|---|---|
| *F21V 15/015* | (2006.01) |
| *F21Y 113/00* | (2016.01) |
| *F21Y 115/10* | (2016.01) |
| *F21V 3/06* | (2018.01) |

(56) References Cited

U.S. PATENT DOCUMENTS

2015/0289349 A1* 10/2015 Kim ..... F21K 9/23
315/34
2015/0351195 A1* 12/2015 Sargent ..... F21V 15/01
315/158

* cited by examiner

LIGHTING APPARATUS

CROSS REFERENCE TO RELATED APPLICATION

This application claims the benefit of priority of Japanese Patent Application Number 2016-192304 filed on Sep. 29, 2016, the entire content of which is hereby incorporated by reference.

BACKGROUND

1. Technical Field

The present disclosure relates to an elongated lighting apparatus.

2. Description of the Related Art

Japanese Unexamined Patent Application Publication No. 2010-050015 discloses a lighting apparatus controlled using a remote control. In such a lighting apparatus, the remote control transmits a control signal to the lighting apparatus by way of infrared communication.

SUMMARY

In a lighting apparatus that operates according to received radio waves, preventing deterioration of radio wave reception performance is problematic.

The present disclosure provides a lighting apparatus capable of preventing deterioration of radio wave reception performance.

A lighting apparatus according to an aspect of the present disclosure is a lighting apparatus that operates according to radio waves received and includes: a main body that is elongated; a light emitter disposed on a top surface of the main body; a light-transmissive cover that is elongated along a lengthwise direction of the main body and covers the light emitter from above; a substrate having a major surface; and a receiver that is disposed on the major surface and receives the radio waves, wherein the substrate is disposed on a side of the main body in the lengthwise direction, in such an orientation that the major surface intersects the lengthwise direction.

According to the present disclosure, it is possible to prevent deterioration of radio wave reception performance of a lighting apparatus.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENTS

Hereinafter, specific description of exemplary embodiments will be carried out with reference to the drawings. It should be noted that each of the exemplary embodiments described below represents a generic or specific example. The numerical values, shapes, materials, structural components, the arrangement and connection of the structural components, etc., shown in the following exemplary embodiments are mere examples, and are not intended to limit the scope of the present disclosure. Furthermore, among the structural components in the following exemplary embodiments, components not recited in any one of the independent claims which indicate the broadest concepts are described as arbitrary structural components.

It should be noted that the respective figures are schematic diagrams and are not necessarily precise illustrations. Furthermore, in the respective figures, substantially identical components are assigned the same reference signs, and overlapping description may be omitted or simplified.

Furthermore, there are instances where coordinate axes are illustrated in the figures used to describe the following exemplary embodiments. The Z-axis direction in the coordinate axes is for example the vertical direction, the Z-axis positive side is referred to as the top side (above/upward) and the Z-axis negative side is referred to as the bottom side (below/downward). Stated differently, the Z-axis direction is the up-down direction or the height direction of the lighting apparatus. Furthermore, the X-axis direction and the Y-axis direction are mutually orthogonal directions in a plane (horizontal plane) perpendicular to the Z-axis direction. The X-axis direction is, in other words, the crosswise direction of the lighting apparatus and the Y-axis direction is, in other words, the lengthwise direction of the lighting apparatus. For example, in the following exemplary embodiments, "shape when seen from the lengthwise direction" means the shape seen from the Y-axis direction.

Embodiment

Overall Configuration

Figure 1:
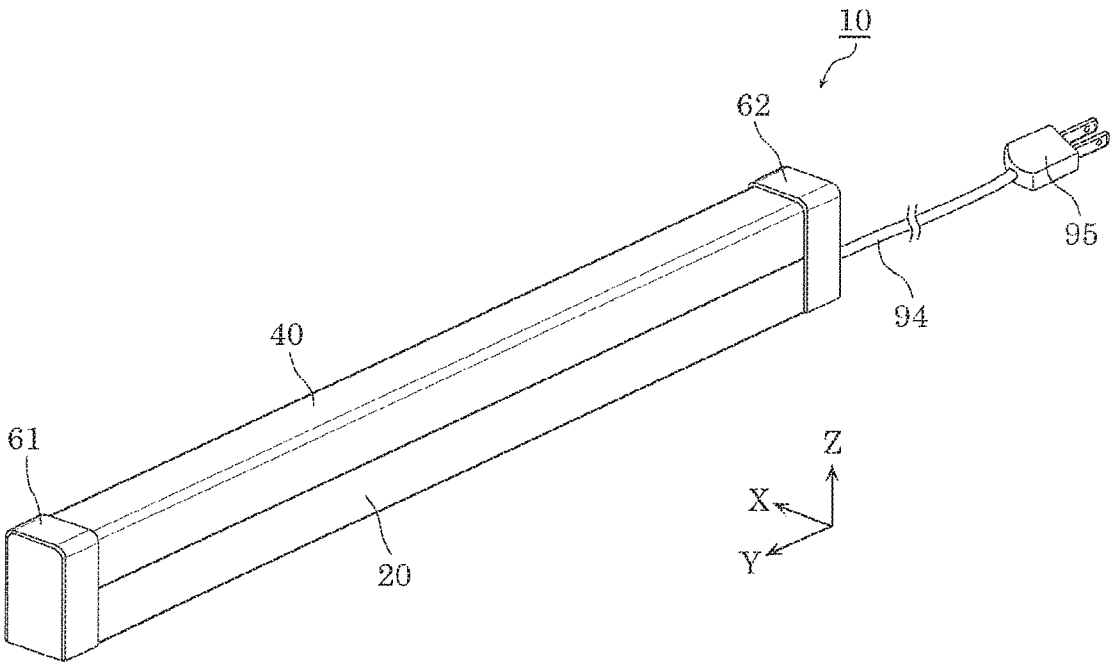
FIG. 1 is an external perspective view of a lighting apparatus according to an exemplary embodiment.
Figure 2:
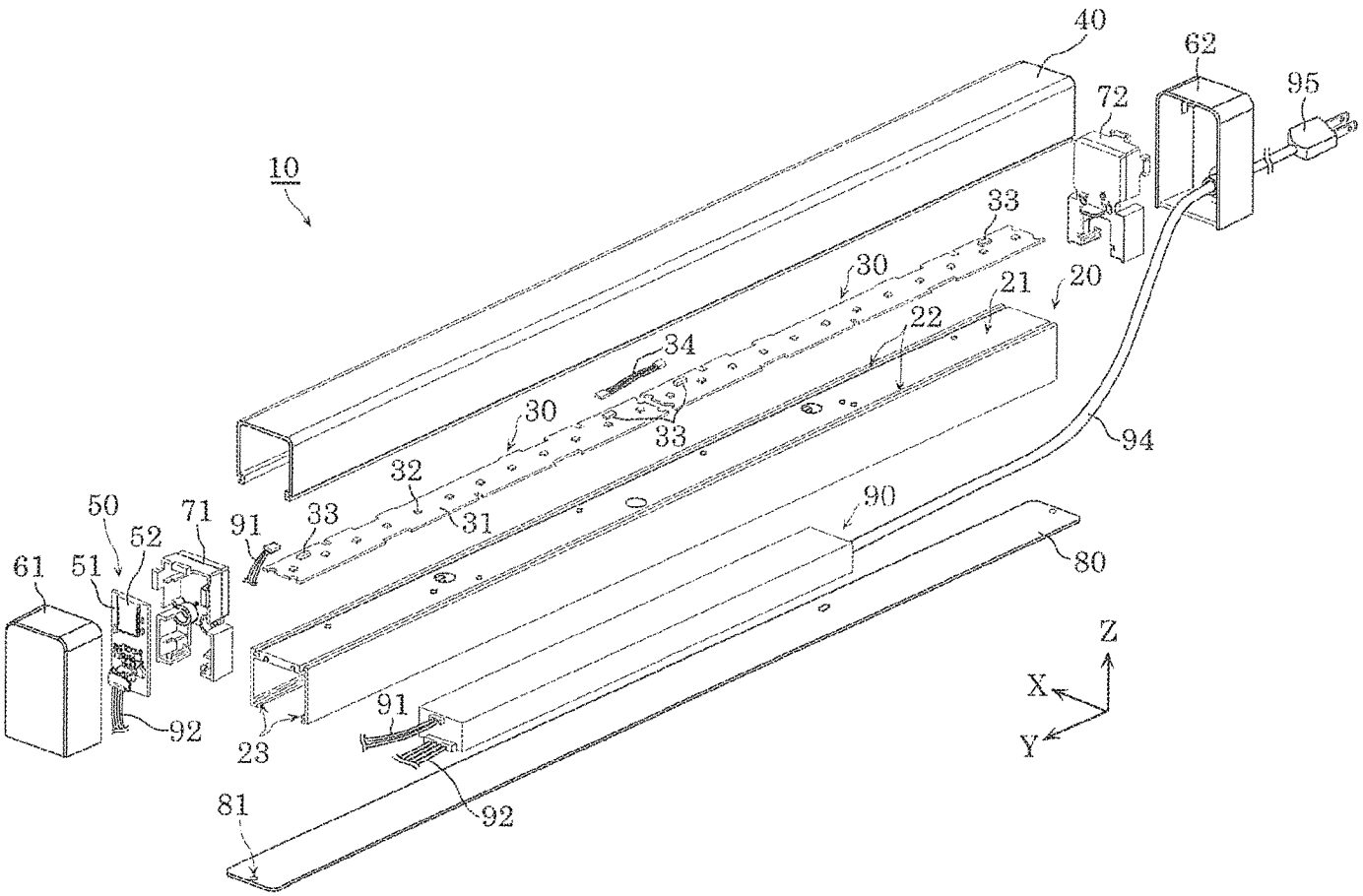
FIG. 2 is a partial exploded perspective view of the lighting apparatus according to the exemplary embodiment.

A configuration of a lighting apparatus according to an exemplary embodiment is described below. FIG. 1 is an external perspective view of a lighting apparatus according to an exemplary embodiment. FIG. 2 is an exploded perspective view of the lighting apparatus according to this embodiment. It should be noted that, in FIG. 2, power supply 90 is schematically illustrated.

As shown in FIG. 1 and FIG. 2, lighting apparatus 10 mainly includes main body 20, light emitters 30, light-transmissive cover 40, wireless communication unit 50, resin cover 61, resin cover 62, board component 80, and power supply 90. Furthermore, lighting apparatus 10 includes attaching component 71, attaching component 72, connector-equipped cable 34, connector-equipped cable 91, connector-equipped cable 92, power supply cable 94, and power supply plug 95.

Lighting apparatus 10, is an elongated lighting apparatus that is used as indirect lighting, and is for example placed on the top surface of a television stand, at a position which is behind the television and with light-transmissive cover 40 facing upward (facing the ceiling). Power supply plug 95 included in lighting apparatus 10 is plugged into a household outlet.

Lighting apparatus 10 receives radio waves, and operates according to the radio waves received. Specifically, lighting apparatus 10 receives a control signal (radio waves) transmitted from an information terminal such as a smartphone or a tablet terminal for example, and turns ON or turns OFF based on the control signal received. When lighting apparatus 10 turns ON based on a control signal, the wall surface behind the television is illuminated. The respective structural components included in lighting apparatus 10 will be described below.

[Main Body]

First, main body 20 will be described. Main body 20 is a component that functions as a mount for light emitters 30. Furthermore, main body 20 also functions as a heat sink for light emitters 30. Main body 20 is an elongated component having the Y-axis direction as a lengthwise direction. Main body 20 is in the shape of a long square tube having a portion that is cut out along the lengthwise direction (Y-axis direction). The cross-sectional shape of main body 20 when seen from the lengthwise direction is that of a downward-opening bracket.

It should be noted that such shape of main body 20 is one example. Main body 20 may have a long tabular shape extending along the Y-axis direction or may have a long square tube shape extending along the Y-direction.

Light emitters 30 are placed on top surface 21 of main body 20. Specifically, top surface 21 is a placement surface of light emitter 30. Furthermore, one of grooves 22 which extend in the Y-axis direction is formed in each of the X-axis direction ends of top surface 21 of main body 20. The bottom ends of light-transmissive cover 40 are slidingly inserted in grooves 22.

Grooves 23 extending in the Y-axis direction are provided on the inner side of the bottom ends of main body 20. Board component 80 is slidingly inserted in grooves 23. In the state where board 80 is inserted in grooves 23, main body 20 and board component 80 form a square tube-shaped case which houses power supply 90 inside. Specifically, power supply 90, which supplies power to light emitter 30, is disposed between main body 20 and board component 80.

Main body 20 is, for example, made of metal. Specifically, main body 20 is made of aluminum but may be made of another metal such as iron.

[Light Emitters]

Next, light emitters 30 will be described. Light emitters 30 are light-emitting devices (light-emitting modules) which function as light sources of lighting apparatus 10. Light emitters 30 are light-emitting devices having a surface mount device (SMD) structure, and include SMD light-emitting elements (LED elements) as described later.

Lighting apparatus 10 includes two light emitters 30, and each of the two light emitters 30 is elongated along the Y-axis direction (i.e., has an elongated shape that is long in the Y-axis direction). The two light emitters 30 are placed on top surface 21 of main body 20, so as to be aligned in the Y-direction. Furthermore, the two light emitters 30 are covered from the above by light-transmissive cover 40. In other words, the two light emitters 30 are disposed between main body 20 and light-transmissive cover 40.

It should be noted that it is sufficient that lighting apparatus 10 includes at least one light emitter 30, and that there is no particular limitation as to the number of light emitters 30. Specifically, each of light emitters 30 includes substrate 31, LED elements 32, and connectors 33.

Substrate 31 is a substantially rectangular elongated substrate extending along the Y-axis direction. Substrate 31 is a composite epoxy material-3 (CEM-3) substrate having resin as a base material, but may be another resin substrate or may be a metal-based substrate or a ceramic substrate. As another resin substrate, flame retardant-4 (FR-4) can be given as an example. As a ceramic board, an alumina substrate comprising an aluminum oxide (alumina) or an aluminum nitride substrate comprising an aluminum nitride, etc., can be given as an examples. Furthermore, as a metal-based substrate, an aluminum alloy substrate, a ferroalloy substrate, or a copper alloy substrate, etc., can be given as examples.

Substrate 31 is screwed onto main body 20 in such an orientation that its lengthwise direction is parallel to the lengthwise direction of main body 20 and its crosswise direction, which is orthogonal to the lengthwise direction, is parallel to the crosswise direction of main body 20. It should be noted that illustration of the screw is omitted in FIG. 1 and FIG. 2.

The first major surface of substrate 31 is the major surface facing light-transmissive cover 40 (major surface on the Z-axis positive side), a plurality of LED elements 32 are mounted (placed) on the first major surface, in one line along the lengthwise direction. Furthermore, connectors 33 are disposed on first major surface of substrate 31. It should be noted that substrate 31 includes printed wiring (not illustrated in the figures) electrically connecting the plurality of LED elements 32 and connectors 33.

The second major surface (major surface on the Z-axis negative side) of substrate 31, which is the major surface on the opposite side of the first major surface, is the major surface facing top surface 21 of main body 20 and is in surface contact with top surface 21 of main body 20. It should be noted that a heat-dissipating component such as heat-dissipating silicone may be disposed between the second major surface of substrate 31 and top surface 21 of main body 20.

LED elements 32 are SMD light-emitting elements and emit white light. Each of LED elements 32 includes a package having a recess, an LED chip mounted on the package recess floor, and a sealant that is filled into the package recess to seal the LED chip. The LED chip is for example a blue LED chip that emits blue light. The sealant is for example a silicone resin containing yttrium aluminum garnet (YAG) series yellow phosphor particles as a wavelength converting material. Furthermore, LED element 32 has metal terminals for mounting LED element 32 on substrate 31.

Connectors 33 are connectors used in the electric connection between each light emitter 30 and power supply 90 and the electrical connection between one light emitter 30 and the other light emitter 30. One connector 33 is disposed on each Y-axis direction end of the first major surface of each substrate 31.

For example, in FIG. 2, one end of connector-equipped cable 91 is connected to connector 33 on the Y-axis positive side of light emitter 30 located on the Y-axis positive side out of the two light emitters 30. The other end of connector-equipped cable 91 is connected to power supply 90. Light emitter 30 and power supply 90 are electrically connected by connector-equipped cable 91.

Furthermore, one end of connector-equipped cable 34 is connected to connector 33 on the Y-axis negative side of light emitter 30 located on the Y-axis positive side out of the two light emitters 30. The other end of connector-equipped cable 34 is connected to connector 33 on the Y-axis positive side of light emitter 30 located on the Y-axis negative side out of the two light emitters 30. In this manner, the two light emitters 30 are electrically connected by connector-equipped cable 34. It should be noted that the two light emitters 30 are, for example, connected in parallel.

[Light-Transmissive Cover]

Light-transmissive cover 40 (globe) makes up an outer shell of lighting apparatus 10 and functions as an outlet for the light from light emitters 30. Light-transmissive cover 40 is a component that is elongated along the Y-axis direction (i.e., has an elongated shape that is long in the Y-axis direction). Light-transmissive cover 40 is in the shape of a long square tube having a portion that is cut out along the lengthwise direction (Y-axis direction). The cross-sectional shape of light-transmissive cover 40 when seen from the lengthwise direction is that of a downward-opening bracket that opens downward.

It should be noted that such shape of light-transmissive cover 40 is one example. Light-transmissive cover 40 may have a long tabular shape extending along the Y-axis direction or may have a long square tube shape extending along the Y-direction.

The bottom ends of light-transmissive cover 40 are connected to main body 20 by being slidingly inserted in grooves 22 provided in top surface 21 of main body 20. In other words, light-transmissive cover 40 is attached to main body 20. Light-transmissive cover 40 which has been attached to main body 20 covers light emitters 30 from above. In the state where main body 20 and light-transmissive cover 40 are connected, the lateral surfaces (surfaces parallel to a Y-Z plane) of main body 20 are substantially flush with the corresponding lateral surfaces of light-transmissive cover 40.

Light-transmissive cover 40 is made of a transparent resin material such as acrylic resin or polycarbonate resin, for example, and transmits the light emitted by light emitters 30. As long as it is light-transmissive, light-transmissive cover 40 may be made of glass. Light-transmissive cover 40 is made of a material that transmits radio waves.

Furthermore, light-transmissive cover 40 has a function (light-dispersing function) of dispersing the light emitted by light emitters 30. For example, light-transmissive cover 40 achieves the light-dispersing function by containing a light-dispersing material such as silica. In this case, light-transmissive cover 40 has a milky-white color. Furthermore, light-transmissive cover 40 may achieve the light-dispersing function by having a lens-shaped structure or recesses or projections formed in at least one of an inner surface or an outer surface of light-transmissive cover 40. Furthermore, light-transmissive cover 40 may achieve the light-dispersing function by having a dot pattern printed on at least one of the inner surface or outer surface of light-transmissive cover 40. Furthermore, light-transmissive cover 40 need not have a light-dispersing function.

[Power Supply]

Power supply 90 converts alternating current power obtainable via power supply plug 95 and power supply cable 94 into direct current power suitable for the light emission by light emitters 30, and outputs the direct current power. Furthermore, power supply 90 converts the alternating current power into direct current power suitable for the operation of wireless communication unit 50, and outputs the direct current power. Power supply 90 includes a power supply circuit and a case in which the power supply circuit is housed.

Specifically, the power supply circuit consists of a substrate and circuit components mounted on the substrate. The circuit components include, for example, a capacitive element such as an electrolytic capacitor or a ceramic capacitor, a resistive element, a coil element, a choke coil (choke transformer), a noise filter, and a diode or a semiconductor element such as an integrated circuit element, etc.

Power supply cable 94 is connected to the Y-axis negative-side end of power supply 90. Accordingly, the power supply circuit and power supply plug 95 are electrically connected. Furthermore, the other end of connector-equipped cable 91 is connected to the Y-axis positive-side end of power supply 90. Accordingly, the power supply circuit and light emitters 30 are electrically connected. The other end of connector-equipped cable 92 is connected to the Y-axis positive end of power supply 90. Accordingly, the power supply circuit and wireless communication unit 50 are electrically connected. It should be noted that connector-equipped cable 92 includes a signal transferring cable and a power supplying cable.

For example, when wireless communication unit 50 (receiver 52) receives a control signal (radio waves) from the information terminal, the power supply circuit obtains the signal from wireless communication unit 50 via connector-equipped cable 92, and turns the supply of direct current power to light emitters 30 ON or OFF based on the obtained signal. The supply of direct current power is carried out via connector-equipped cable 91.

[Resin Covers and Attaching Components]

Figure 3:
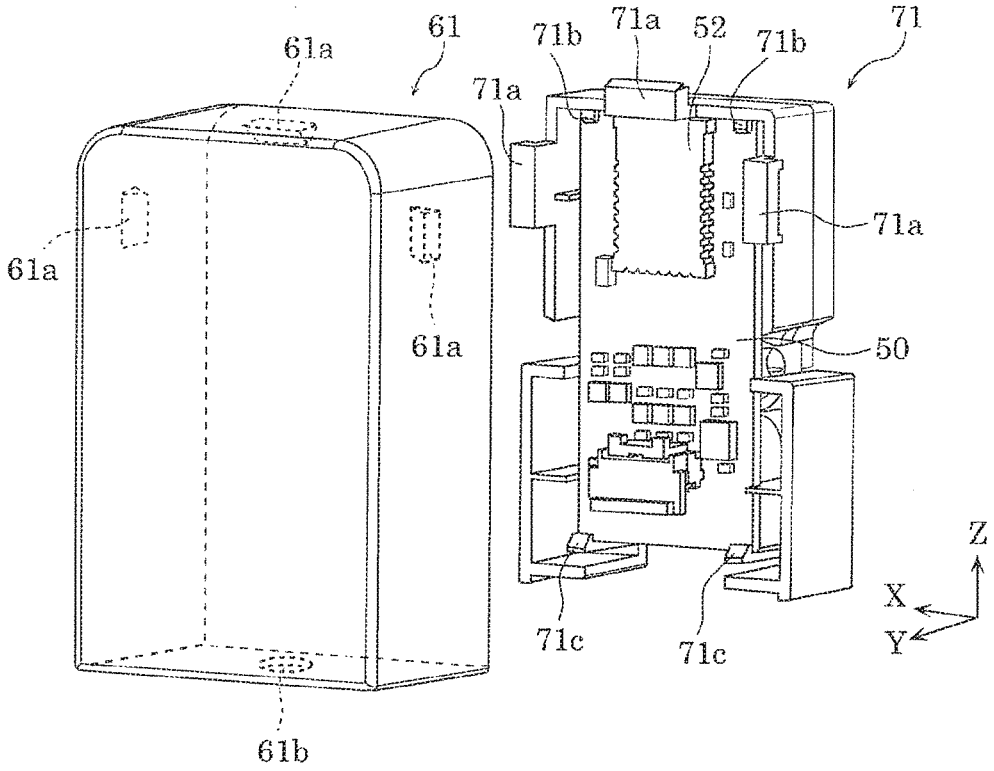
FIG. 3 is a perspective view for describing the structure of a resin cover and an attaching component.

Next, resin cover 61 and attaching component 71 will be described with reference to FIG. 3 in addition to FIG. 1 and FIG. 2. FIG. 3 is a perspective view for describing the structure of resin cover 61 and attaching component 71.

Resin cover 61 has a bottomed tube shape, and is a component that collectively covers the Y-axis positive-side ends of main body 20, light-transmissive cover 40, and board component 80. In other words, resin cover 61 is disposed on a side of main body 20 in the lengthwise direction. Furthermore, resin cover 61 contains wireless communication unit 50 (substrate 51 and receiver 52). Stated differently, resin cover 61 forms, between resin cover 61 and the Y-axis positive-side end of main body 20 (attaching component 71), a space in which wireless communication unit 50 is housed.

The shape of resin cover 61 as seen from the Y-axis direction (i.e., the shape of the bottom of the bottomed tube shape) is substantially rectangular, with long sides in the up-down direction. The shape of resin cover 61 as seen from the Y-axis direction is specifically a rectangle with the two upper corners round.

Resin cover 61 is, for example, made of a resin material such as polybutylene terephthalate (PBT) or a polycarbonate resin. Resin cover 61 is made of a material that transmits radio waves. It should be noted that, unlike in a typical straight-tube LED lamp, resin cover 61 does not include a base.

Attaching component 71 is a component used in the attachment of resin cover 61, and is screwed onto the Y-axis positive side of main body 20. Attaching component 71 has, in a Y-axis positive-side upper portion, three locking portions 71*a* which project outward. In the inner surfaces of the upper portion of resin cover 61, three projections 61*a* are disposed corresponding to the three locking portions 71*a*. Resin cover 61 is attached to attaching component 71 by way of projections 61*a* engaging with locking portions 71*a*.

Screw insertion hole 61*b* is provided at the bottom portion of resin cover 61. The bottom portion of resin cover 61 that has been attached to attaching component 71 is secured to board component 80 by way of the screw (not illustrated in FIG. 1 to FIG. 3) which is inserted into screw insertion hole

61*b* from the bottom being screwed into screw hole 81 (illustrated in FIG. 2) formed in the Y-axis positive-side end of board component 80.

Furthermore, as illustrated in FIG. 3, attaching component 71 includes two projections 71*b* for holding wireless communication unit 50 and two claws 71*c* for holding wireless communication unit 50. Projections 71*b* are disposed on the top portion of attaching component 71 and project downward, and claws 71*c* are disposed at the bottom portion of attaching component 71 and project upward. Wireless communication unit 50 is held in attaching component 71 by having its top end positioned further in the Y-axis negative side than projections 71*b*, and having its bottom end pushed from the Y-axis positive side to the Y-axis negative side so as to climb past claws 71*c*.

Resin cover 71 is, for example, made of a resin material such as polybutylene terephthalate (PBT) or a polycarbonate resin. Attaching component 71 may be made of a material that transmits radio waves.

It should be noted that resin cover 62 has substantially the same structure as resin cover 61, and attaching component 72 has substantially the same structure as attaching component 71. The points of difference of resin cover 62 from resin cover 61 and the points of difference of attaching component 72 from attaching component 71 will be described below.

Resin cover 62 has a bottomed tube shape, and is a component that collectively covers the Y-axis negative-side ends of main body 20, light-transmissive cover 40, and board component 80. Resin cover 62 is different from resin cover 61 in having an opening (a through hole) through which power supply cable 94 is inserted. Although resin cover 62 does not contain wireless communication unit 50 (substrate 51 and receiver 52), in the case where wireless communication unit 50 is held by attaching component 72, resin cover 62 contains wireless communication unit 50.

Attaching component 72 is a component used in the attaching of resin cover 62, and is screwed onto the Y-axis negative side of main body 20. Although wireless communication unit 50 is not held in attaching component 72, wireless communication unit 50 may be held by attaching component 72.

[Wireless Communication Unit]

Figure 4:
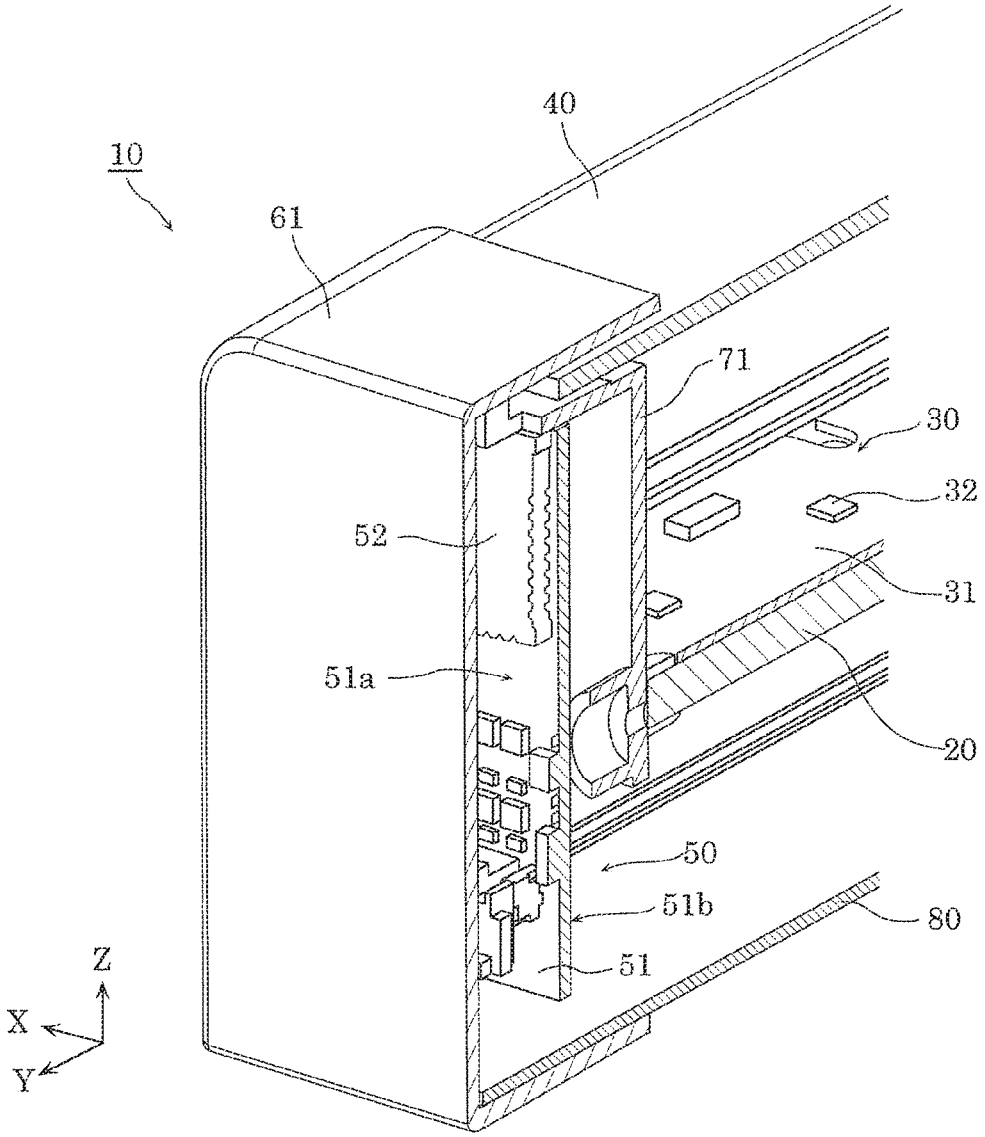
FIG. 4 is a cross-sectional view of the surroundings of a wireless communication unit of the lighting apparatus according to the exemplary embodiment.

Next, wireless communication unit 50 is described with reference to FIG. 4 in addition to FIG. 2 and FIG. 3. FIG. 4 is a partial cross-sectional view of the surroundings of wireless communication unit 50 of lighting apparatus 10.

Wireless communication unit 50 is a wireless module (wireless communication device) for receiving control signals from the information terminal. Wireless communication unit 50 includes substrate 51 and receiver 52.

Substrate 51 is a substrate having a rectangular plan view shape. Substrate 51 may be made of any material in the same manner as substrate 31.

Major surface 51*a* of substrate 51 is the surface which faces resin cover 61, and on which receiver 52 and other circuit components making up a wireless communication circuit are mounted. Furthermore, major surface 51*b* of substrate 51 is the surface facing attaching component 71, and, in this embodiment, circuit components are not mounted on major surface 51*b*. Part of the circuit components making up the communication circuit may be mounted on major surface 51*b*.

Receiver 52 receives radio waves. Specifically, receiver 52 is an antenna module (antenna device) including a chip antenna or a pattern antenna, etc., and receives control signals transmitted via radio waves from the information terminal. Visible light and infrared light are not included in the radio waves.

Although ZigBee (registered trademark), Bluetooth (registered trademark), or a wireless local area network (LAN) can be given as examples of a wireless communication standard (protocol) to be used in the reception by receiver 52, there is no particular limitation as to the wireless communication standard. Furthermore, there is no particular limitation as to the radio wave frequency band to be used in the wireless communication.

Figure 5:
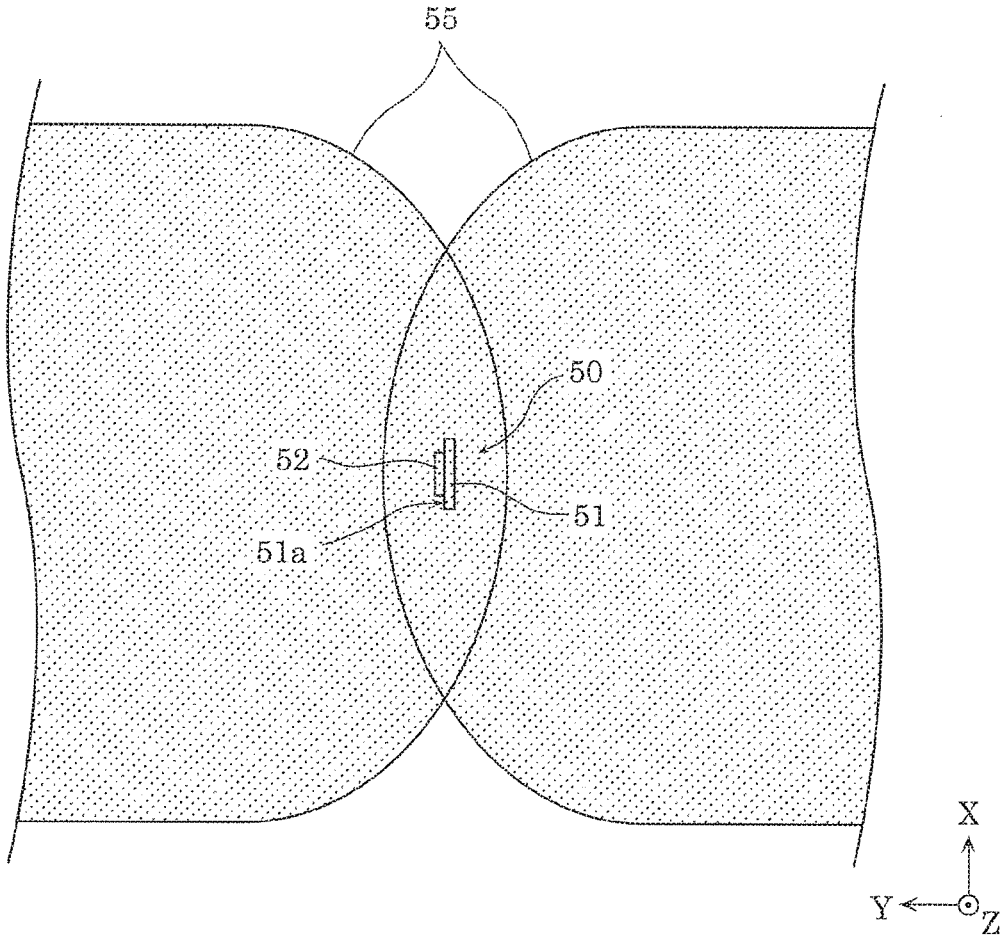
FIG. 5 is a diagram schematically illustrating an example of ranges within which a receiver can receive radio waves.

Furthermore, the ranges within which receiver 52 can receive radio waves are wider in the Y-axis direction than in the X-axis direction. FIG. 5 is a diagram schematically illustrating an example of ranges within which receiver 52 can receive radio waves. In FIG. 5, the ranges within which receiver 52 can receive radio waves (hereafter also referred to as receivable ranges 55) are schematically indicated by dot hatching. It should be noted that receivable ranges 55 illustrated in FIG. 5 are ranges in an ideal case where obstructions to radio waves are not present around receiver 52.

As illustrated in FIG. 5, receiver 52 has directivity in receivable ranges 55. Receivable ranges 55 are wider in a direction orthogonal to major surface 51*a* of substrate 51 (i.e., the Y-axis direction) than in directions parallel to major surface 51*a* (i.e., the X-axis direction and the Z-axis direction). Specifically, since receiver 52 has a relatively high reception performance in a direction orthogonal to major surface 51*a* of substrate 51, receiver 52 can receive mainly radio waves in the direction orthogonal to major surface 51*a* of substrate 51.

[Placement of Wireless Communication Unit]

Figure 6:
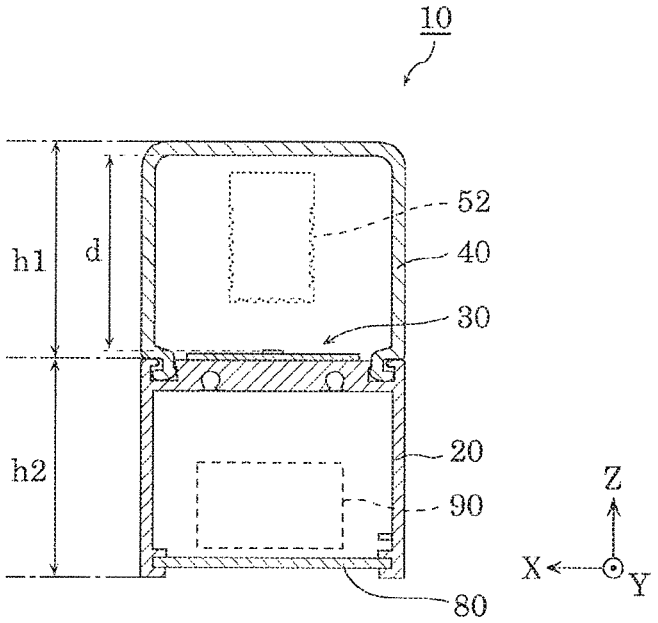
FIG. 6 is a cross-sectional view of the lighting apparatus according to the exemplary embodiment, taken along a plane perpendicular to the lengthwise direction.

Next, the placement of wireless communication unit 50 is described. Description is carried out with reference to FIG. 6 in addition to FIG. 2 to FIG. 4. FIG. 6 is a cross-sectional view of lighting apparatus 10 taken along a plane perpendicular to the lengthwise direction. It should be noted that, in FIG. 6, receiver 52 and power supply 90 are illustrated using broken lines.

In order for light of uniform brightness to be emitted from lighting apparatus 10, distance d (illustrated in FIG. 6) in the up-down direction (Z-axis direction) between light emitters 30 and light-transmissive cover 40 may be long. In particular, in lighting apparatus 10 including light emitters 30 of the SMD structure, lengthening distance d enables reduction of graininess in the light emitted by lighting apparatus 10.

Furthermore, components other than light emitters 30 are, for example, placed so as not to obstruct the light emitted by light emitters 30. Accordingly, in lighting apparatus 10, it is necessary to take into consideration the placement of power supply 90 which is comparatively larger in size.

In view of this, a shape that is long in the up-down direction when seen from the Y-axis direction is adopted for lighting apparatus 10 to be able to secure distance d and place power supply 90 in the space between main body 20 and board component 80. Specifically, the external shape of lighting apparatus 10 when seen from the Y-axis direction (the lengthwise direction of main body 20) is a substantially rectangular shape that is long in the up-down direction. It should be noted that substantially rectangular means a shape that is substantially close to a rectangle. The external shape of lighting apparatus 10 when seen from the Y-axis direction (the lengthwise direction of main body 20) is specifically that of a rectangle with the two corners on the top side (the two corners on the light-transmissive cover 40-side) being rounded.

In lighting apparatus 10, wireless communication unit 50 is placed by utilizing such shape that is long in the up-down direction. Specifically, substrate 51 of wireless communication unit 50 is disposed in a side of main body 20 in the lengthwise direction, in such an orientation that major surface 51*a* intersects the lengthwise direction.

With this, wireless communication unit 50 can be placed at a position that does not obstruct the light emitted by light emitters 30. Furthermore, in lighting apparatus 10, wireless communication unit 50 is disposed outside of main body 20 which is made of metal, and thus receivable ranges 55 of receiver 52 are not easily obstructed. In other words, deterioration of the reception performance of receiver 52 can be prevented.

It should be noted that although, in lighting apparatus 10, substrate 51 of wireless communication unit 50 is disposed in such an orientation that major surface 51*a* is substantially orthogonal to the lengthwise direction, it is sufficient that substrate 51 is disposed in such an orientation that major surface 51*a* intersects the lengthwise direction.

Furthermore, although receiver 52 may be placed at any position in major surface 51*a* of substrate 51, in lighting apparatus 10, receiver 52 is placed on the top side of major surface 51*a* of substrate 51. As a result, as illustrated in FIG. 6, when seen from the Y-axis direction (the lengthwise direction of main body 20), receiver 52 is positioned between main body 20 and light-transmissive cover 40. More specifically, the entirety of receiver 52 is positioned between main body 20 and light-transmissive cover 40.

Accordingly, since main body 20 and receiver 52 do not overlap in the Y-axis direction, deterioration of reception performance of receiver 52 can be prevented. Such a configuration is particularly useful in the case where radio wave receivable ranges 55 of receiver 52 are wider in the Y-axis direction than in the X-axis direction, as illustrated in FIG. 5, It should be noted that, in lighting apparatus 10, outwardly visible height h1 of light-transmissive cover 40 is substantially equal to outwardly visible height h2 of main body 20. Accordingly, since the balance of outward appearance between light-transmissive cover 40 which transmits light (i.e., the light-emitting portion of lighting apparatus 10) and main body 20 which does not emit light (i.e., the non light-emitting portion of lighting apparatus 10) is improved, design characteristics can be improved. It should be noted that outwardly visible height h1 of light-transmissive cover 40 refers to the length in the up-down direction of the portion of light-transmissive cover 40 that is visible from the outside. This is the same for outwardly visible height h2 of main body 20.

[Advantageous Effects, Etc.]

As described above, lighting apparatus 10 that operates according to radio waves received includes: main body 20 that is elongated; light emitters 30 disposed on top surface 21 of main body 20; and light-transmissive cover 40 that is elongated along a lengthwise direction (Y-axis direction) of main body 20 and covers light emitters 30 from above. Lighting apparatus 10 includes substrate 51 having major surface 51*a*; and receiver 52 that is disposed on major surface 51*a* and receives the radio waves. Substrate 51 is disposed on a side of main body 20 in a lengthwise direction, in such an orientation that major surface 51*a* intersects the lengthwise direction.

Accordingly, substrate 51 and receiver 52 can be placed at positions that do not obstruct the light emitted by light emitters 30, by utilizing the space at the side of main body 20. Furthermore, since substrate 51 and receiver 52 are disposed outside of main body 20, deterioration of the reception performance of receiver 52 can be prevented even when main body 20 is made of metal.

Furthermore, light-transmissive cover 40 may be made of a material that transmits the radio waves, main body 20 may be made of metal; and, when seen from the lengthwise direction of main body 20 (i.e., the Y-axis direction), receiver 52 may be disposed between main body 20 and light-transmissive cover 40.

Accordingly, since main body 20 and receiver 52 do not overlap in the lengthwise direction, deterioration of reception performance of receiver 52 can be prevented.

Furthermore, lighting apparatus 10 may further include resin cover 61 that is disposed on the side of main body 20 in the lengthwise direction and contains substrate 51 and receiver 52.

Accordingly, substrate 51 and receiver 52 can be protected while preventing deterioration of reception performance of receiver 52.

Furthermore, when seen from the lengthwise direction of main body 20, light-transmissive cover 40 may have a cross-sectional shape in a form of a downward-opening bracket, and light-transmissive cover 40 may have bottom ends that are connected to top surface 21 of main body 20.

Accordingly, light emitters 30 can be housed between light-transmissive cover 40 and main body 20.

Furthermore, top surface 21 of main body 20 may have grooves 22 extending in the lengthwise direction, and the bottom ends of light-transmissive cover 40 may be connected to top surface 21 of main body 20 by sliding insertion into grooves 22.

Accordingly, light-transmissive cover 40 can be easily attached to main body 20.

Furthermore, when seen from the lengthwise direction of main body 20, main body 20 may have a cross-sectional shape in the form of the downward-opening bracket. Lighting apparatus 10 may further include: board component 80 that is connected to bottom ends of main body 20, and elongated along the lengthwise direction of main body 20; and power supply 90 that is disposed between main body 20 and board component 80, and supplies power to light emitters 30.

Accordingly, power supply 90 can be housed in a position that does not obstruct the light emitted by light emitters 30.

Furthermore, when seen from the lengthwise direction, lighting apparatus 10 may have an external shape that is substantially rectangular, with long sides in an up-down direction.

Accordingly, a space for placing rectangular substrate 51 and receiver 52 can be created on the side of main body 20 in the lengthwise direction.

Furthermore, light-transmissive cover 40 may have outwardly visible height h1 substantially equal to outwardly visible height h2 of main body 20.

Accordingly, since the balance of outward appearance between the light-emitting portion of lighting apparatus 10 and the non light-emitting portion of lighting apparatus 10 is improved, design characteristics can be improved.

Other Embodiments

Although an embodiment has been described thus far, the present invention is not limited to the foregoing embodiment.

For example, in the foregoing embodiment, the lighting apparatus is described as being used for indirect lighting. The present invention, however, can also be applied to other lighting apparatuses. For example, the present invention may be realized as a lighting apparatus to be used for direct lighting. For example, the present invention may be realized as an elongated ceiling light. Furthermore, the present invention may be realized as other indirect lighting such as architectural lighting, etc.

Furthermore, the light emitters are not limited to light-emitting modules having the SMD structure as described above. For example, a light-emitting module having a chip-on-board (COB) structure may be used as a light emitter. In a light-emitting module having the COB structure, an LED chip is directly mounted on a substrate, and the LED chip is sealed by a light-transmissive sealant containing phosphor particles. Furthermore, a remote-phosphor light-emitting module, which includes an LED chip and a resin material containing phosphor particles disposed at a position that is remote from the LED chip may be used as a light emitter.

Furthermore, although LED chips are used as light-emitting elements in the light-emitting modules in the forgoing embodiment, other solid-state light-emitting elements such as semiconductor light-emitting elements such as a semiconductor laser, or organic electroluminescent (EL) elements or non-organic EL elements, etc., may be used as light-emitting elements.

Furthermore, although the lighting apparatus has a radio wave receiving function in the foregoing embodiment, lighting apparatus 10 may further have a radio wave transmitting function. In this case, the present invention realizes a light emitting apparatus having improved radio wave transmitting performance.

Forms obtained by various modifications to the exemplary embodiments that can be conceived by a person of skill in the art as well as forms realized by combining structural components of different exemplary embodiments, which are within the scope of the essence of the present invention may be included in the scope of the one or more aspects.

What is claimed is:

1. A lighting apparatus that operates according to radio waves received, the lighting apparatus comprising:

a main body that is elongated;

a light emitter disposed on a top surface of the main body;

a light-transmissive cover that is elongated along a lengthwise direction of the main body and covers the light emitter from above;

a substrate having a major surface;

a receiver that is disposed on the major surface and receives the radio waves, and a power supply that supplies power to the light emitter through a first cable connected to the light emitter, and that supplies power to the receiver through a second cable directly connected to an electrical connector on the substrate, the second cable including a power supply cable that supplies power to the receiver and a signal transferring cable that receives control signals from the receiver, wherein the substrate is disposed on a side of the main body in the lengthwise direction, in such an orientation that the major surface intersects the lengthwise direction.

2. The lighting apparatus according to claim 1, wherein the light-transmissive cover is made of a material that transmits the radio waves, the main body is made of metal; and when seen from the lengthwise direction, the receiver is disposed between the main body and the light-transmissive cover.

3. The lighting apparatus according to claim 1, further comprising:

a resin cover that is disposed on the side of the main body and contains the substrate and the receiver.

4. The lighting apparatus according to claim 1, wherein when seen from the lengthwise direction, the light-transmissive cover has a cross-sectional shape in a form of a downward-opening bracket, and the light-transmissive cover has bottom ends that are connected to the top surface of the main body.

5. The lighting apparatus according to claim 4, wherein the top surface of the main body has grooves extending in the lengthwise direction, and the bottom ends of the light-transmissive cover are connected to the top surface of the main body by sliding insertion into the grooves.

6. The lighting apparatus according to claim 4, wherein when seen from the lengthwise direction, the main body has a cross-sectional shape in the form of the downward-opening bracket, the lighting apparatus further includes a board component that is connected to bottom ends of the main body and elongated along the lengthwise direction, and the power supply is disposed between the main body and the board component.

7. The lighting apparatus according to claim 1, wherein when seen from the lengthwise direction, the lighting apparatus has an external shape that is substantially rectangular, with long sides in an up-down direction.

8. The lighting apparatus according to claim 1, wherein the light-transmissive cover has an outwardly visible height substantially equal to an outwardly visible height of the main body.

* * * * *